United States Patent [19]

Caubet

[11] 4,335,151

[45] Jun. 15, 1982

[54] METHOD FOR DECORTICATING SEEDS

[75] Inventor: Jacques-Jean Caubet, St. Etienne, France

[73] Assignee: Centre Stephanois de Recherches Mecaniques Hydro-Mecanique et Frottement, France

[21] Appl. No.: 137,385

[22] Filed: Apr. 4, 1980

Related U.S. Application Data

[63] Continuation of Ser. No. 909,801, May 26, 1978, abandoned, which is a continuation-in-part of Ser. No. 696,462, Jun. 16, 1976, abandoned.

[30] Foreign Application Priority Data

Jun. 16, 1975 [FR] France ..... 75 19495

[51] Int. Cl.[3] ..... B02B 3/00

[52] U.S. Cl. ..... 426/482; 241/7; 241/8; 426/519

[58] Field of Search ..... 426/483, 482, 518, 519, 426/288; 99/514, 516, 519, 525, 568, 571, 518, 520, 524, 526; 209/144, 3; 241/7, 8, 9, 39, 40

[56] References Cited

U.S. PATENT DOCUMENTS

| | | | |
|---|---|---|---|
| 758,664 | 5/1904 | Kimball | 426/483 |
| 1,699,441 | 1/1929 | Negro | 99/524 X |
| 2,620,841 | 12/1952 | Jacobson | 99/518 X |
| 2,759,511 | 8/1956 | Jacobson | 99/519 |
| 3,080,905 | 3/1963 | Noren | 241/7 |
| 3,102,569 | 9/1963 | Forsberg | 99/519 |
| 3,782,968 | 1/1974 | Herzberg et al. | 241/7 X |

FOREIGN PATENT DOCUMENTS

| | | |
|---|---|---|
| 1334642 | 10/1973 | United Kingdom . |
| 1351656 | 5/1974 | United Kingdom . |

*Primary Examiner*—Kenneth M. Schor
*Attorney, Agent, or Firm*—Remy J. VanOphem

[57] ABSTRACT

A method and apparatus for decorticating or peeling seeds is disclosed. The seed kernels are separated from their hulls by feeding the seeds into a turbulent flow compressed air stream in a flow passage of sufficient length to accelerate the seeds to high velocity in the air stream and then flowing the compressed air stream into a passage of much larger cross-sectional area. This causes a sudden and large reduction in the compressed air stream velocity and decrease in pressure exerted on the seeds which in turn produces a reversal of stresses which were exerted in the kernel and the hull during acceleration, separating the kernel from the hull. The turbulent flow and mechanical forces created by collisions with the flow passage and between individual seeds increases the efficiency of the process. The process is repeated to produce a complete decortication by staging a series of flow passages of the type described, each successive stage receiving the output of the previous stage.

7 Claims, 14 Drawing Figures

METHOD FOR DECORTICATING SEEDS

CROSS REFERENCE TO RELATED APPLICATION

This application is a continuation of co-pending patent application Ser. No. 909,801, filed May 26, 1978, now abandoned, which in turn was a continuation-in-part application of co-pending application Ser. No. 696,462, filed June 16, 1976, now abandoned.

BACKGROUND OF THE INVENTION

1. Field of the Invention

The present invention concerns the operation of peeling vegetable products such as corn, grains, berries, or cereals having a kernel in a protective envelope.

2. Description of the Prior Art

The known methods for peeling or decorticating cereal seeds or the like usually consist of submitting the seeds to mechanical efforts in order to break the hulls. According to one known method, the seeds are passed between two cylinders rotating at different speeds, separating the hull from the kernel by mechanical friction. According to another known method, the cereal seeds are accelerated (for example centrifugally) and projected against a wall so that the seed hulls are broken upon impact.

One of the main drawbacks of apparatus carrying out one of these known mechanical methods is that the percentage of kernels broken is much too high. For example, in an apparatus consisting of two rotary cylinders, it is impossible to adjust the distance between the cylinders in a satisfactory manner. This is because a given type of cereal has seeds of varying sizes. Therefore, either the distance between the cylinders is fixed to limit the percentage of broken kernels, in which case, the smallest seeds are not peeled; or the distance is adjusted to peel and decorticate all the seeds and in this case, the biggest kernels are all broken.

In an apparatus using centrifugation and projection, there is the same impossibility of obtaining both a high percentage of peeled seeds and a low percentage of broken kernels; the kernels have a tendency to be broken on impact with the walls.

It is, therefore, an object of the present invention to avoid these drawbacks and to provide a pneumatic device using a new method for completely peeling or decorticating seeds or cereal seeds without breaking the seed kernels.

SUMMARY OF THE INVENTION

A process according to the invention for peeling cereal seeds or similar vegetable bodies is characterized in that:

a decompression zone is created at the inlet of seeds to be peeled;

compressed air is injected for suction of the seeds which are then submitted both to high pressure and to rapid acceleration;

the seeds are circulated in a path along which they are submitted to pressure variations such that the following combination of factors generates between each kernel and its hull, stresses sufficient for separating the kernel and the envelope:

difference of kinetic energy between the kernel and the hull of each seed;

directional variation of the seed stream;

rapid succession of overpressures and decompressions.

All along the seed flow path, turbulences appear which generate a great number of elementary shocks between individual seeds and between the seeds and the walls of the path. These shocks also cause peeling without breaking the kernels.

During the process, the seeds undergo three successive flow periods, namely:

(1) In the small diameter flow passage, the jet of compressed air acts directly on the envelope of the seed which acts as the driving element of the seed;

(2) The jet of air is suddenly slowed and the pressure reduced while the seed initially remains at the speed it had reached in the small diameter flow passage;

(3) Then, while the seed has a higher velocity than that of the air, the kernel which is heavier than its air-resisting hull, becomes the driving element of the seed.

Thus, when a seed progresses from the small diameter flow passage to the large diameter flow passage, the direction of the stresses generated between a kernel and its hull is changed.

A device implementing the method of the invention has an acceleration unit with an air jet nozzle and a spout feeding into a first tube through which the seeds are aspirated. The opposite end of the first tube opens into a second tube of larger cross section so that the seed stream conditions are suddenly modified. The device employs any known means for supplying the seeds to the acceleration unit, discharging the separated hulls, and delivering the peeled kernels.

The tube walls impart the secondary mechanical effect of friction, or micro-shocks which improve the decortication efficiency. Furthermore, the variable diameter flow passage stages are repeated wherein a mixture of seeds and separated kernels (with hulls evacuated) are subjected to successive acceleration units.

According to one embodiment of the invention, the acceleration unit has a calibrated nozzle which allows variation of air flow and pressure according to the type of seed.

According to another embodiment, the compressed air jet is directed downwardly so that the seeds flow through the pipes both by gravity and nozzle aspiration.

According to other embodiments, the nozzle has an annular shaped exhaust producing a bundle of parallel air jets, while the seeds to be hulled are supplied outside of the bundle. It is also possible to use another type of nozzle for producing an annular flow of compressed air jets converging towards a spout having a circular cross section. When the air jet has an annular shape, the seeds can be supplied from either inside or outside of the air jet, or both. The lower opening could also be slit-shaped where the spout cross section is rectangular.

Also, the exhaust of the first stage of a peeling device can open into a suction chamber aspirating the separated hulls, while the kernels and unseparated seeds are sent to a second air jet in a second acceleration unit for repetition of the decortication operation.

The above-mentioned examples are given for illustrative purposes only and are not limiting. The main characteristic of the invention is the violent suction of seed or vegetable bodies to be peeled with the attendant generation of internal stresses between the kernel and the hull of each seed, followed by the sudden reversal of the internal stresses along the flow circuit.

DETAILED DESCRIPTION OF THE PREFERRED EMBODIMENT

Figure 1:
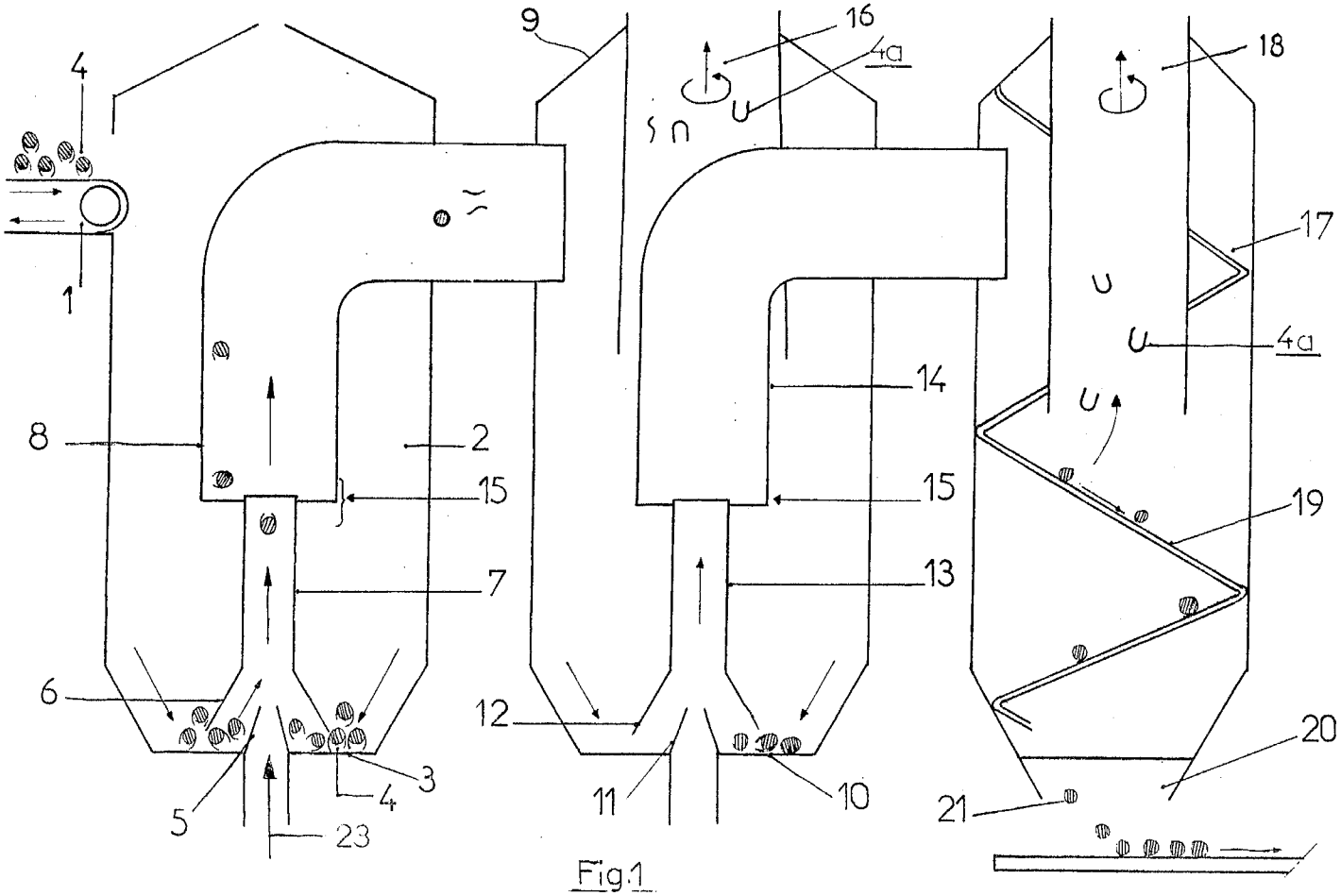
FIG. 1 is a general view of a device according to the invention.

FIG. 1 illustrates a peeling device, having three successive stages. The structure and the number of stages are not intended to be limited to this example. A supply system 1 sends the seeds 4 into a first stage vessel 2, while the bottom 3 of the vessel 2 receives the seeds 4. The bottom 3 is provided with a nozzle 5. A spout 6 is provided at the lower end of a first tube 7, the upper end of the first tube 7 opening into a second turned tube 8. The cross-sectional area of the second tube 8 is at least four (4) times greater in area than the area of the first tube 7.

A jet 23 of compressed air of at least about 200 meters per second velocity emitting at two atmospheres pressure is sent through the acceleration unit (nozzle 5/spout 6) to form a suction system which aspirates or inducts the seeds 4 up through the tube 7.

In the small diameter portion 7, the trailing portion of the seed, closest to the nozzle, has exerted on its outer surface, a pressure greater than about 300 millibars; while the leading edge experiences pressures somewhat less than about 300 millibars. The observed turbulent or eddy flows cause pressures of greater than 40 millibars on the sides of the seeds, perpendicular to the direction of seed flow. Turbulence in the small diameter portions 7 and 13 are characterized by Reynolds numbers of greater than about 8000.

The air stream velocity at the entrance to the large diameter flow passage decreases rapidly to about 15 meters per second and the pressure decreases to a value somewhat greater than about two bars. The air flow in the large diameter passage is greater than about 80 cubic meters per hour.

In the systems tested, the flow passage diameters were about 10 mm and about 40 mm. The system as described herein, can process a seed mass flow rate of somewhat greater than about 300 kg per hour.

In the zone 15 around the sudden cross section variation of the tubes 7 and 8, the conditions of pressure and speed within the air flow are considerably modified. As hereunder explained, the flowing seeds are submitted in tube 8 to stresses quite different from the stresses in tubes 7. At location 15, the seeds decelerate hyperbolically with a maximum deceleration greater than 600 meters per second$^2$.

At the top of vessel 9, the second end of tube 8 opens into the upper portion of the vessel 9 of the devices second stage (central part of FIG. 1). Similar to the first stage, the second stage comprises:

a vessel 9, the bottom 10 of which has a suction or acceleration unit (nozzle 11 and sprout 12);

a flow and decortication circuit made of tubes 13 and 14 having different cross sections, to define another deceleration zone 15.

Moreover, the upper part of vessel 9 in the second stage is provided with discharge means such as centrifugal separator 16, in order to evacuate the separated empty hulls.

The tube 14 in the second stage is connected to the upper part of the third stage vessel 17. The top of the vessel 17 is provided with a centrifugal separator 18 for discharging by suction, the separated empty envelopes, i.e., the lighter products. The side walls of vessel 17 are provided with a helical deflector 19, the lower end of which is connected to a hopper 20 for delivering the peeled or decorticated kernels 21, and eventually for sending the later to a pickup-out system of known type (not shown).

FIGS. 2 to 8 illustrate the details of the flow zones in the seed stream. They show the distribution of stresses between kernel and hull along the flow circuit.

Figure 2:
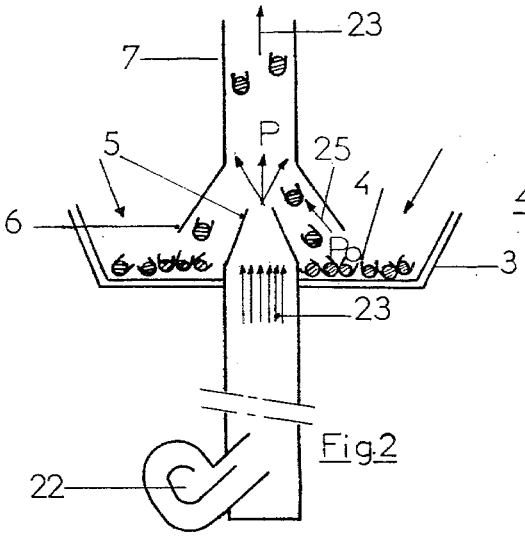
FIG. 2 shows a large scale nozzle/spout acceleration unit.

An air generator 22 having a variable output blows compressed air through nozzle 5 (arrow 23). At the nozzle outlet, the air jet 23 penetrates into the spout 6 and the tube 7, thus generating a low pressure area near the bottom 3 which carries the seeds 4. The pressure difference ($P-P_o$) between the pressure P in the air jet and the pressure $P_o$ near the bottom 3 induces a suction effect, aspirating the seeds 4 towards the compressed air jet (arrow 25). Therefore, each seed 4 being stationary on the bottom 3 at $P_o$ pressure, is accelerated in a short distance (length of spout 6) up to an increased velocity and pressure (FIG. 2). The nozzle/spouts system injects the seeds 4 into the air jet 23 wherein they are quite suddenly accelerated.

Figure 3:
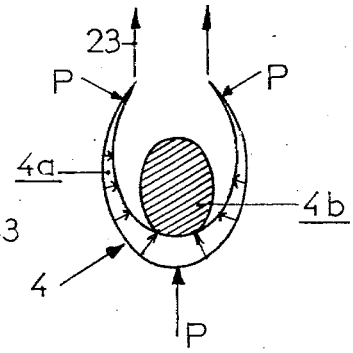
FIG. 3 illustrates the stresses generated on the hull of a seed at aspiration.

The air pressure P first applies to the hull of seeds 4 flowing through tube 7. The air jet movement is transmitted to the hull **4*a*, which in turn drives the kernel 4*b*. The inertia difference between the hull 4*a* (lighter) and the kernel 4*b* (heavier) generates stresses between hull and kernel. Additional stresses are created by pressure variations on the seeds during the acceleration phase. Thus, the seeds are successively at the decompression $P_o$ pressure, at the air jet pressure P, greater than about two atmospheres, and at the inner pressure p of tube 7. The length of said tube 7 should not be less than about 100 mm to permit the seeds to reach a speed of greater than 70 meters per second (FIGS. 2 and 3**).

The flow rate and pressure of the air jet are adjustable to the kind of seeds to be peeled.

Inside tubes 7, the air stream is turbulent. A number of small shocks are produced both between the individual seeds, and between the seeds and the walls. These small shocks assist the decortication of the seeds without breaking the kernels **4*b***.

When the tube 7 opens into the tube 8, the flow passage cross-sectional area suddenly increases. In this zone 26, the air speed thus rapidly decreases to less than about 15 meters per second. The seeds 4 are heavier than the air and their inertia is, therefore, greater. They momentarily remain at substantially the same speed as at the outlet from acceleration tube 7. This is especially true for the kernel portion of the seed, the density of which is greater than that of the hull portion. Also, the air pressure applied to the hulls 4*a* decreases to a value $P_o$ which is lower than p.

Figure 4:
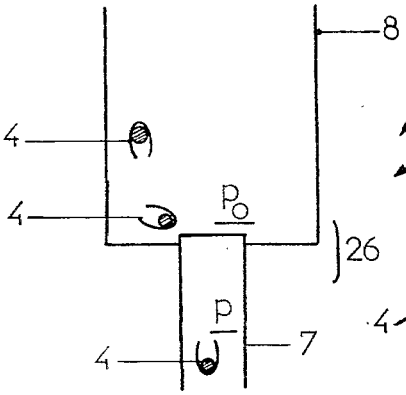
FIG. 4 shows the deceleration zone where the seeds are turned over.
Figure 5:
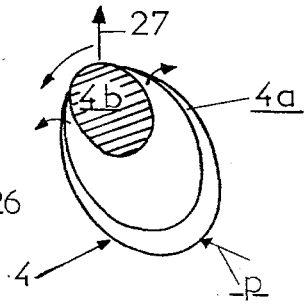
FIGS. 5 and 6 show, in large scale, the stresses generated between the kernel and the hull in the turn-over zone.
Figure 6:
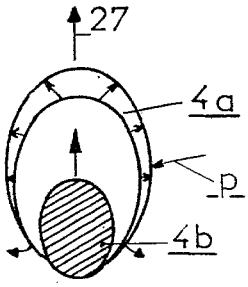

The combination of these phenomena in zone 26 has the following results:

(a) prior to its deceleration, a seed 4 is moving more rapidly than the air around it;

(b) the hull 4*a* is more readily decelerated than the kernel 4*b* while the seed is being turned over;

(c) at zone 26, the stresses between hull 4*a* and kernel 4*b* are reversed, which favors decortication (FIGS. 4, 5 and 6).

Figure 7:
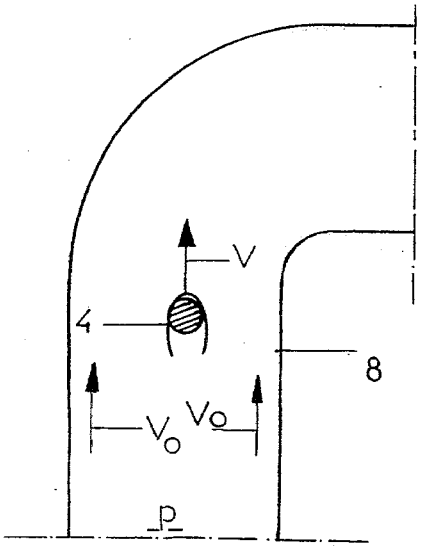
FIG. 7 shows the orientation of the seed in the last portion of the decortication circuit.
Figure 8:
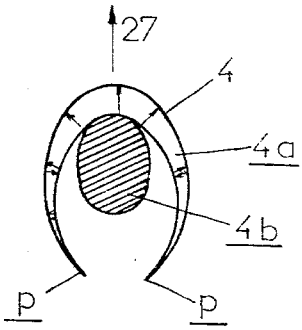
FIG. 8 shows, in large scale, a seed similar to that of FIG. 7, illustrating the direction of the stresses between the kernel and its hull.

Within tube 8, the seed has been turned over, while its movement stays the same as indicated by arrow 27 (FIGS. 5 and 6). This turning over is due to the modification of the flowing dynamic conditions. The seeds 4 are flowing at a speed V higher than the air speed $V_o$. Moreover, the kernel 4*b* is moving faster than the hull 4*a*. The kernel 4*b* becomes the motor element driving the seed 4, and the stress between the kernel and the hull is the inverse of the stress generated during the acceleration phase inside tube 7 (FIGS. 7 and 8).

The changes in speed and pressure together with the use of inertia differences generate substantial internal stresses which result in the separation of kernel and hull. This separation is facilitated by secondary mechanical effects such as friction between adjacent seeds, shocks against the tube walls, etc. The amplitude of the secondary effects is insufficient for complete decortication but repetition of these mechanical effects along the flow circuit improves the efficiency of decortication.

A number of similar acceleration and deceleration units can be mounted in series in order to successively carry out several peeling cycles. The separated empty hulls can be eliminated in one final step or after each separation.

FIGS. 9 to 13 illustrate various embodiments for the suction and acceleration unit nozzle/spout. These examples are not intended to be limiting.

Figure 9:
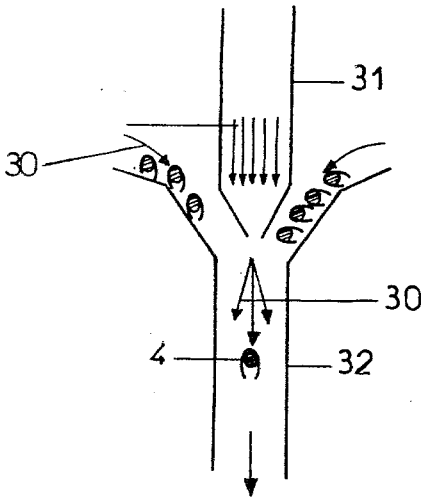
FIG. 9 illustrates a nozzle/spout suction system directed downwardly.

In FIG. 9, the compressed air jet 30 is directed downwardly through tubes 31 and 32. Gravity forces are cumulative with the suction effect of the nozzle/spout unit.

The air flow or jet can be from an annular shaped nozzle. The air jet then has the shape of a cylindrical (FIG. 10) or conical (FIG. 12) hollow surface. In the first case (FIG. 10), the nozzle 33 has an annular chamber 34 supplied with air at 35, and opening into a straight annular passage 36. The latter in turn opens in front of spout 37. In the second case (FIG. 12), the air outlet bundle 41 is directed by a conical passage, converging towards the axis of the nozzle/spout unit 39-38.

Figure 10:
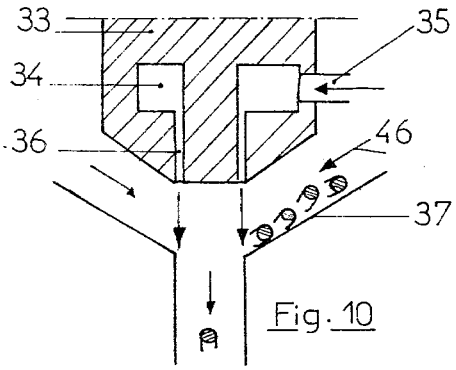
FIG. 10 shows another embodiment generating an annular air jet.
Figure 12:
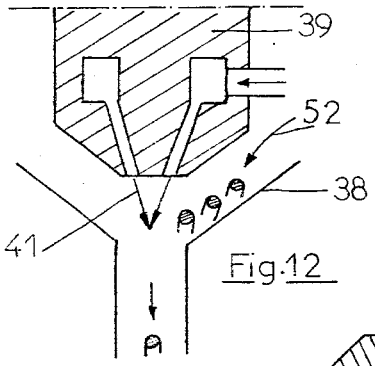
FIGS. 12 and 13 are other embodiments of a nozzle/spout unit having convergent tubular air jets.

In the embodiments shown in FIGS. 10 and 12, the seeds are supplied from outside the nozzle.

Figure 11:
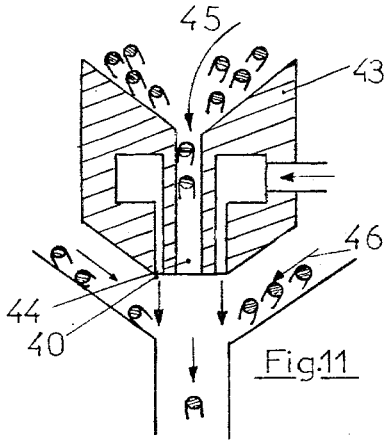
FIG. 11 corresponds to FIG. 10 with a seed supply both inside and outside the annular air jet.
Figure 13:
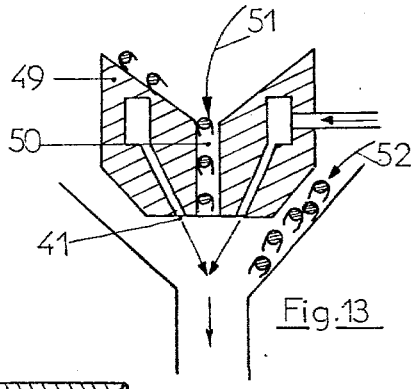

In FIGS. 11 and 13, the nozzles 43 and 49 respectively generate the same air jet as nozzles 33 and 39, but they have a central opening 44 or 50 permitting a seed supply, either from inside the annular jet, or both from inside the (arrows 45 and 51) and from outside (arrows 46 and 52) with respect to the compressed air annular jets 40 and 41 (FIGS. 11 and 13).

Figure 14:
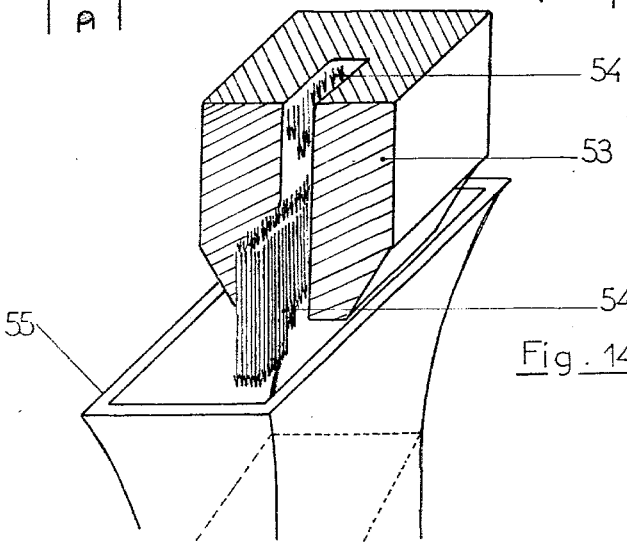
FIG. 14 shows a suction nozzle/spout unit with a flat air jet.

Another suction system comprises a nozzle 53 delivering a compressed air flow 54 which is blade-shaped, i.e. flat (FIG. 14). In this case, the cross-section of the corresponding spout 55 is rectangular.

Having described my invention, the examples and specification given are not intended to be limiting and one skilled in the art could vary the method or apparatus of the invention without departing from the spirit thereof.

What is claimed is:

1. A method of decorticating seeds having a kernel enclosed within a seed hull comprising the steps of:

(a) rapidly accelerating the seeds by introducing the seeds into a turbulent stream of compressed air in a first flow passage;

(b) passing said seeds and said stream of air as a seed stream from said first flow passage into a smaller cross sectional second flow passage whereby the seed hulls are accelerated relative to the seed kernels and flowing said seed stream in said second passage until the seeds are traveling at substantially the same velocity as the air stream;

(c) passing said seeds and stream of air from said second flow passage into a substantially larger cross sectional third flow passage producing a great reduction in air stream pressure and velocity;

(d) adjusting the pressure and flow conditions in said air stream to produce a sufficiently great reduction in pressure and velocity when said air stream passes into said third flow passage to produce separation of the kernel and hull of a substantial proportion of said seeds in said third flow passage by deceleration and depressurization of said seeds such that the speed of the seed kernel increases relative to the speed of the seed hull such that said seeds are decorticated by the change in flow conditions; and (e) repeatedly subjecting said seeds to said steps so as to produce a complete decortication of said seeds.

2. The method according to claim 1, wherein, said air stream is directed into said first flow passage by means of a nozzle and wherein said seeds are introduced into said air stream by feeding a supply of said seeds into a clearance space between said nozzle directing said compressed air stream into said first flow passage and the opening of said first flow passage.

3. The method according to claim 2 wherein said seeds are introduced by aspiration into said air stream.

4. The method according to claim 2 wherein said seeds are introduced into said air stream by gravity feed.

5. The method according to claim 1, further comprising the step of separating the collective hulls of said seeds from the collective kernels of said seeds.

6. The method according to claim 5 wherein the collective hulls are separated from the collective kernels of said seeds by a cyclone separator.

7. The method according to claim 1 further comprising repeating the steps of claim 1 to enhance separation of the kernels from the hulls of said seeds.

* * * * *